United States Patent [19]

Dickson et al.

[11] 4,328,603

[45] May 11, 1982

[54] STREET SWEEPING MACHINE

[76] Inventors: Donald L. Dickson, 1860 Arbolita Dr., La Habra, Calif. 90631; Steven L. Dickson, 243 Long Branch Cir., Brea, Calif. 90621

[21] Appl. No.: 214,263

[22] Filed: Dec. 8, 1980

Related U.S. Application Data

[62] Division of Ser. No. 80,532, Oct. 1, 1979, Pat. No. 4,308,632.

[51] Int. Cl.[3] ..... E01H 1/04

[52] U.S. Cl. ..... 15/84; 198/856; 340/676

[58] Field of Search ..... 15/82–87, 15/340; 198/502, 856; 340/626, 676

[56] References Cited

U.S. PATENT DOCUMENTS

| | | | |
|---|---|---|---|
| 2,917,761 | 12/1959 | Burgdorff | 15/84 |
| 3,416,676 | 12/1968 | Nolin, Jr. | 198/856 |
| 3,649,982 | 3/1972 | Mortensen | 15/84 |
| 3,963,115 | 6/1976 | Teske et al. | 198/502 |

*Primary Examiner*—Edward L. Roberts
*Attorney, Agent, or Firm*—Gene W. Arant

[57] ABSTRACT

A street sweeping vehicle with a single engine both for the purpose of propulsion and generation of hydraulic power. The hydraulic power is used to drive individual hydraulic motors controlling the main broom, gutter broom and debris elevating system. Each separate hydraulic motor is so positioned as to operate effectively while accomodating various drine positions, yet minimizing wear and tear on the mechanism driven.

2 Claims, 13 Drawing Figures

STREET SWEEPING MACHINE

This is a division of application Ser. No. 80,532, filed Oct. 1, 1979, now U.S. Pat. No. 4,308,632.

BACKGROUND OF THE INVENTION

Vehicles specially designed for street sweeping operations have been used for many years. The vehicle typically has four wheels and carries a main broom which is located behind the rear wheels. The main broom is of cylindrical configuration, extends transversely of the vehicle, and is powered so that it rotates in the proper direction to sweep material forward and underneath the vehicle. A debris elevating system is located within the vehicle and operates in such a manner as to receive debris and rubbish at the street surface forwardly of the main broom, and then raises this material upward and dumps it in a bin that is also carried by the vehicle. The typical street sweeping vehicle also includes a pair of side brooms, known in the trade as gutter brooms, which are designed to gather material from the sides of the vehicle and propel it inwardly so that it comes under the control of the main broom and the debris elevator system.

One of the problems which faces the operators of street sweeping vehicles is the unevenness or irregularity of the street surfaces over which the vehicle must operate. In general, it appears that streets cannot be designed for the most effective operation of street sweeping machines; rather, street sweeping machines must accommodate the existing pecularities of the streets that they are designed to sweep. It has therefore been necessary to design street sweeping machines so that they will readily accommodate themselves to uneven and irregular terrain.

In addition to mere irregularities in the terrain surface, the street sweeping machine also from time to time encounters actual physical obstacles, such as curbs, parked vehicles, and the like. It is necessary for the operator or driver of the street sweeping machine to provide appropriate guidance for his vehicle to avoid collisions or minimize their resulting damage. From time to time undesirable collisions do occur and the vehicle should therefore be properly designed to survive such collisions and maintain its operating efficiency.

As a result of the factors just discussed, wear and tear experienced on street sweeping machines has been considerable. Maintenance requirements have imposed a heavy burden of time and expense.

The object and purpose of the present invention is to provide an improved street sweeping machine which is far less susceptible to wear and tear than previously known machines, and which therefore requires a greatly reduced amount of maintenance time and expense.

SUMMARY OF THE INVENTION

According to the present invention the sweeper mechanism is simplified, and the reliability of its operation is greatly improved, by substituting hydraulic drive means in place of the chain drives or gear and shaft drives that have been traditionally used.

More specifically, a separate hydraulic motor is positioned adjacent each one of the devices that requires an independent power drive. Thus there is one hydraulic motor to drive the main broom, a separate hydraulic motor for driving each of the gutter brooms, and still another hydraulic motor for driving the debris elevator system.

According to the present invention the articulating suspension for the main broom has been appropriately modified to cooperate with the hydraulic drive.

According to the present invention the hydraulic motor for driving the elevator system is positioned in such a way as to avoid the requirement for a chain drive mechanism that has been previously used in vehicles of this type.

The gutter brooms are particularly susceptible to shocks, and according to the present invention the hydraulic motor for each of the gutter brooms is so positioned as to overcome the need for a chain drive or other elaborate power drive train, while still maintaining the flexibility of movement of the gutter broom, and at the same time adequately protecting the hydraulic motor so that it is not damaged by the road shocks that are typically encountered by the gutter broom.

DRAWING SUMMARY

PREFERRED EMBODIMENT

Figure 1:
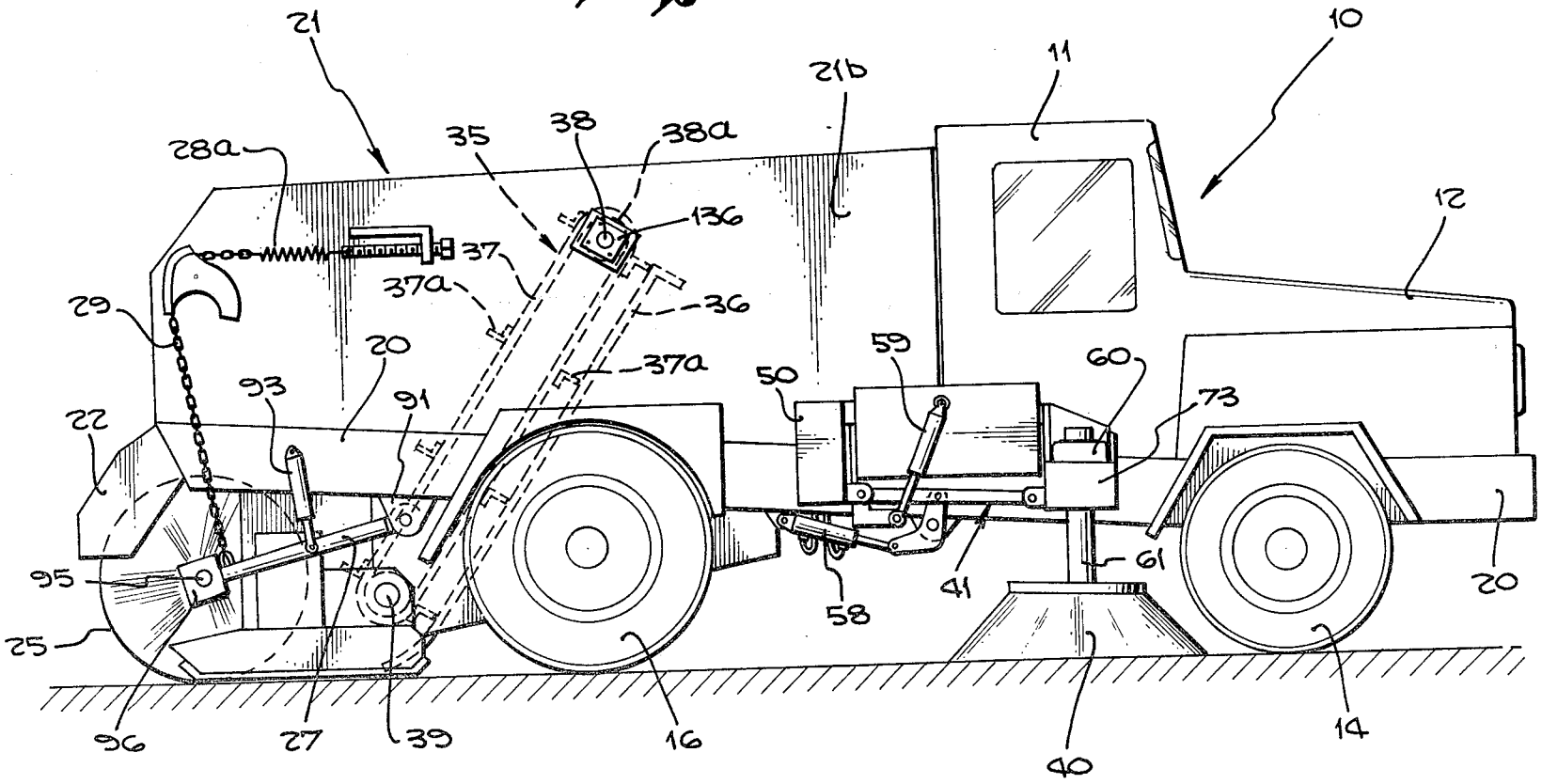
FIG. 1 is a side elevation view of the right-hand side of a street sweeping machine in accordance with the invention.

Reference is now made to the drawings, FIGS. 1 to 13, inclusive, illustrating the presently preferred form of the invention. The arrangement of the vehicle as a whole will first be described, and for that purpose reference is particularly made to FIGS. 1 and 2.

The vehicle generally identified by reference numeral 10 is equipped with a driver's cab 11 and engine hood 12, which are entirely conventional. The vehicle has front wheels 13, 14 and rear wheels 15, 16, the right-hand wheels 14 and 16 being shown in FIG. 1 while the left-hand wheels 13 and 15 are seen in FIG. 2.

A chassis 20 extends the full length of the vehicle and provides the support for the engine, not shown, and for the hood and driver's cab. To the rear of the cab is a main frame or housing 21 which either houses or supports most of the sweeper mechanism. A cover or shield 22 hangs downwardly from the rearward end of the chassis 20. Main broom 25 is of generally cylindrical configuration and is positioned beneath the rearward end of chassis 20 where it is partly covered by the shield 22. A broom arm 26 on the left side of the vehicle (FIG. 2) and a broom arm 27 on the right side of the vehicle (FIG. 1) support the main broom from the main frame. Maximum downward movement of the main broom is limited by support chains 28 and 29 carried on respective sides of the vehicle main frame. Each chain is supported by a spring such as spring 28*a* shown in FIG. 2, and provision is made for adjustment of its length, in accordance with conventional practice.

Figure 2:
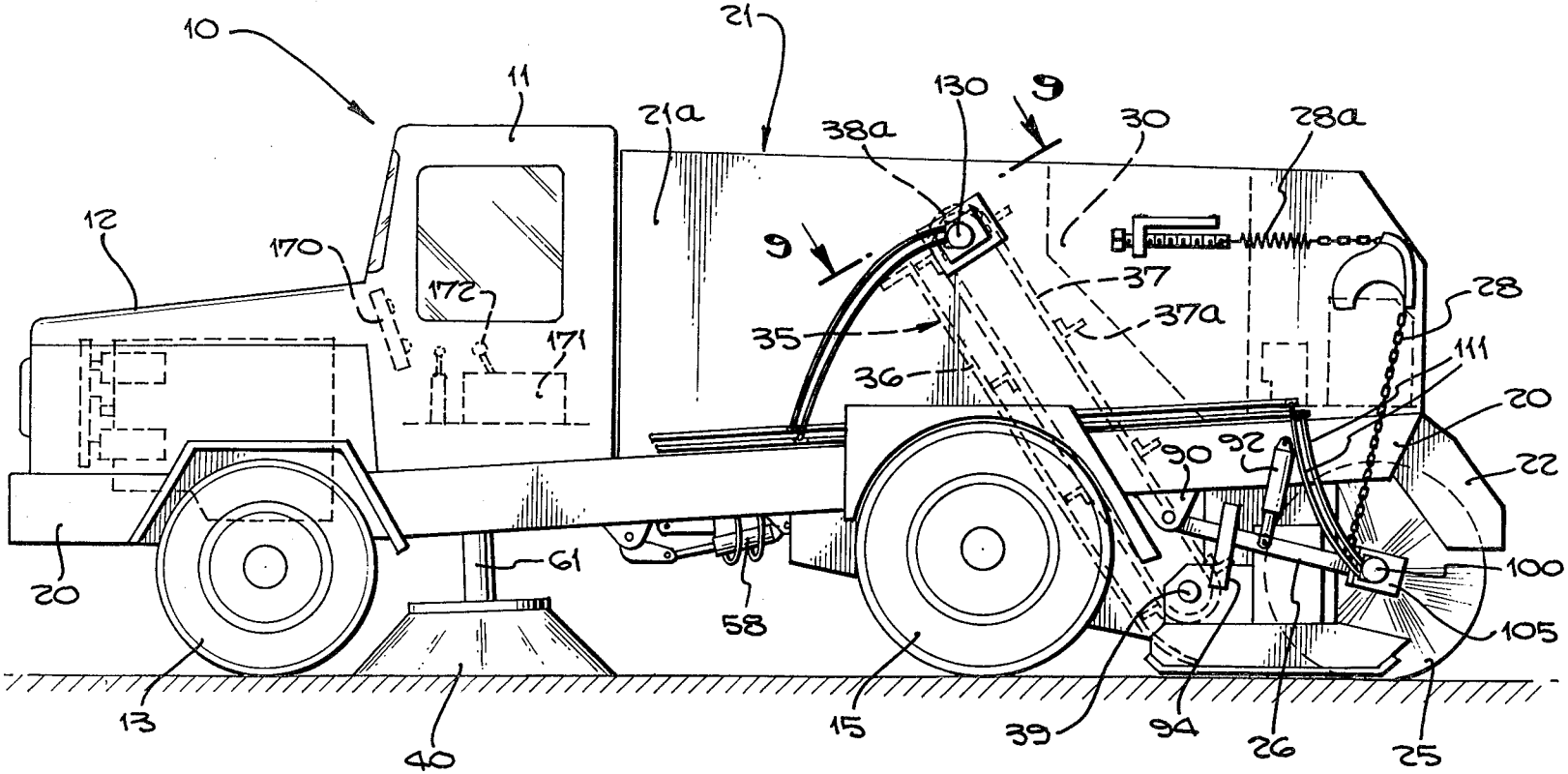
FIG. 2 is a side elevation view of the vehicle but showing the left-hand side.

A water tank 30 shown by dotted lines in FIG. 2 is of conventional construction, and provides water for a spraying system that is used to keep down dust during the street sweeping operations.

A debris elevator system 35 shown in dotted lines both in FIG. 1 and FIG. 2 is now briefly described with reference to FIG. 1. A pan 36 is sloped at an angle of about 40 degrees to the vertical, its lower end extending near to the roadway surface intermediate to the main broom 35 and the rear wheels 15, 16. The upper end of pan 36 empties into a dirt bin, not shown, that is carried inside the main frame 21 of the vehicle. Shafts 38, 39 are located at the upper and lower ends, respectively, of the pan 36 and spaced some distance to the rear of it. A set of chains 37 extend in a continuous loop around both the upper shaft 38 and the lower shaft 39. The chains 37 carry a series of outwardly extending paddles 37*a* which, during the normal operation of the apparatus, are driven in such a direction as to sweep the debris from the street surface upward along the surface of the pan 36 and then dump it into the dirt bin. The elevator system 35 is generally conventional except for the bearing and drive arrangement associated with the upper shaft 38, which will be described in a later chapter of this description.

The street sweeping vehicle 10 also includes a gutter broom 40 carried immediately behind the right front wheel 14 (FIG. 1). As shown in FIG. 1 the gutter broom 40 may be selectively raised or lowered by adjusting the position of an adjustable side frame 41 which has the form of a parallelogram. Another similar gutter broom may be positioned behind left front wheel 13.

Figure 3:
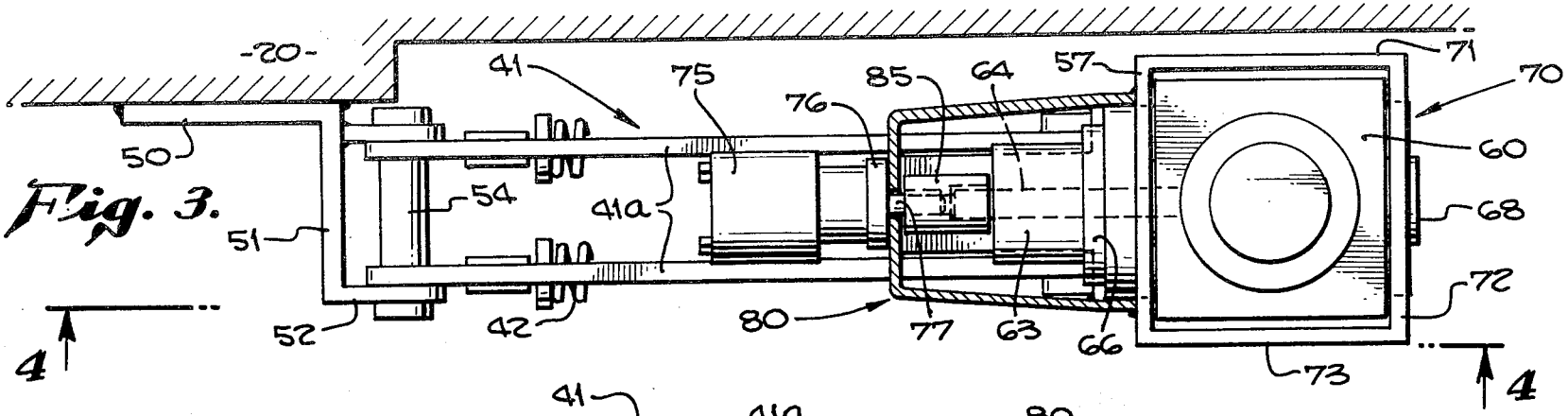
FIG. 3 is a top plan view, partially in cross-section, of the suspension and drive mechanism for the left-hand gutter broom.
Figure 4:
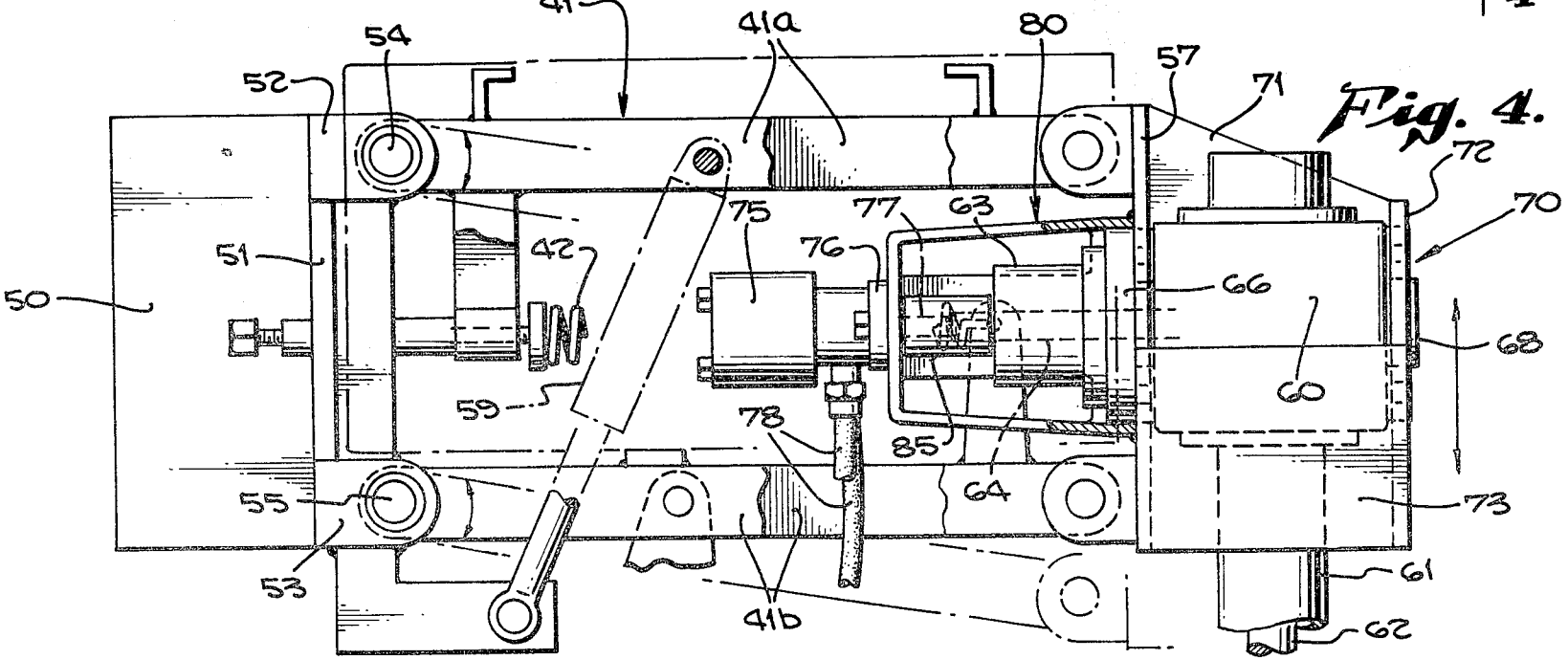
FIG. 4 is an elevation view taken on the line 4—4 of FIG. 3.

GUTTER BROOM SUSPENSION AND DRIVE (FIGS. 1, 3, and 4)

As shown in FIG. 3, a plate 50 is welded to the vehicle chassis 20. Plate 50 is of L-shaped configuration and has a perpendicular portion 51 that extends transverse to the vehicle. An upper pair of ears 52 and a lower pair of ears 53 extend forward from the plate 51. The upper ears 52 receive a pivot shaft 54 while the lower ears 53 receive a pivot shaft 55.

The auxiliary frame 41 includes a pair of upper arms 41*a* which are normally horizontal and extend forward from the pivot shaft 54, and a pair of lower arms 41*b* which likewise are normally horizontal and extend forward from the lower pivot shaft. At the forward end of the auxiliary frame a plate 57 is disposed parallel to the plate 51 and receives the forward ends of the pivot arms 41*a*, 41*b*. Completing the conventional construction of the auxiliary frame is a lifting cylinder 58 (FIG. 1) which is actuated for raising or lowering the auxiliary frame 41, and a separate hydraulic cylinder 59 having its lower end supported from chassis 20 and its upper end pivotally secured to one of the arms 41*a* for acting as a shock absorber. The construction of the parallelogram frame and its raising and lowering mechanism is entirely conventional.

A most important element in the apparatus for suspending and driving the gutter broom 40 is a right-angle gear box 60. As best seen in FIG. 4 the gear box 60 has a downwardly depending output shaft housing 61 that contains an output shaft 62. The lower end of shaft 62 is attached to the center of the circular gutter broom 40. The gear box at its upper end has an input housing 63 that extends towards the left, or the rear of the vehicle. It contains an input shaft 64 shown only in dotted lines.

A support housing for the gear box is generally designated as 70 and includes the plate 57 previously identified, a plate 72 forming a forward wall that is parallel to the plate 57, and plates 71, 73 forming inner and outer side walls, respectively. Gear box 60 is positioned in this support housing 70 but is free to move to some extent therein. The gear box also includes a journal or trunnion 66 on its rear or input side and a journal or trunnion 68 on its forward side. These trunnions ride within circular openings in the plates 57, 72, respectively. The gear box is, therefore, able to pivot about 10 degrees in either direction about the longitudinal axis of its input shaft 64.

A hydraulic motor 75 is used to drive the gutter broom 40 through the gear box 60. The hydraulic motor 75 has a housing or base part 76 through which an output shaft 77 extends. The motor is energized through flexible hoses 78, FIG. 4.

An auxiliary housing 80 is positioned between the support housing 70 for the gear box and hydraulic motor 75. Housing 80 has a generally cup-shaped hollow configuration. The closed or bottom end of the cup is positioned next to the hydraulic motor 75 and is rigidly attached to the motor base or housing 76. The other or open end of the cup is abutted against plate 57 of the support housing 70 and is welded thereto.

Completing the power drive train is a rigid coupler 85 which encompasses the outer ends of the output shaft 70 of the hydraulic motor and the input shaft 64 of the gear box, and rigidly secures those two shafts together in axially aligned relationship. As a result of this arrangement, hydraulic fluid received through the hoses 78 energizes the motor 75, causes output shaft 77 to turn relative to the base 76, which in turn rotates the input shaft 64 of gear box 60 and hence its output shaft 62. Thus the gutter broom 40 is driven in a rotating movement.

It is of some importance that the gear box 60 preferably includes a reducing gear mechanism which reduces the applied input speed to half. Hydraulic motor 75 therefore runs at twice the rotating speed of the gutter broom 40.

In the operation of the gutter broom the lifting cylinder 58 is used by the operator to raise or lower the broom as needed. The conventional tension springs 42 and hydraulic shock absorber 59 associated with the parallelogram 41 serve to provide more precise vertical positioning of the broom. The broom also pivots to some extent about the longitudinal axis of output shaft 77 of the hydraulic motor, this action being permitted by the trunnions which support the gear box 60 inside the support housing 70, as previously described. The spacing between the gear box and its support housing 70 is sufficient to allow a maximum angular movement of ten degrees in either direction, which is sufficient to accommodate the position of the gutter broom to commonly encountered street surfaces. This pivoting movement also provides a mechanical inertia system for absorbing lateral shocks that are imposed on the broom.

The street sweeping machine which is illustrated in the present drawings is of a type made by Athey Products Corporation, Post Office Box 669, Raleigh, N.C. 27602 under its trademark MOBIL SWEEPER. In this machine as originally designed an internal combustion engine drove the gutter broom through a gear and shaft power train. In a recently marketed modification of this product, Athey Products Corporation has utilized a hydraulic motor which is positioned directly upon the gutter broom so that the motor shaft and the broom shaft are axially aligned. That mechanism, however, has proved troublesome in practice. The problem that has been experienced is that road shocks encounted by the broom will cause the hydraulic motor to freeze up and stop operating, thus requiring expensive shutdowns of the machine.

According to the modification provided by the present invention this problem has been overcome. The pivotal swinging action of the gear box and broom, as previously described, substantially absorbs lateral shocks without imparting them into the motor. And the length of the drive train from the output shaft of the motor through rigid coupler 85 and input shaft 64 into the gear box 60, together with the inner mechanism of the gear box, has sufficient resilience to provide a shock absorbing function and avoid motor freeze-up.

MAIN BROOM SUSPENSION AND DRIVE (FIGS. 1, 2, 5–8)

As best seen in FIGS. 1 and 2 a pair of brackets 90, 91 are attached to the vehicle chassis 20 just rearward of the rear wheels. These brackets pivotally support the forward ends of the broom support arms 26, 27, respectively. In addition to the chains previously mentioned for restraining downward movement of the arms, each arm also has an associated hydraulic shock absorber, including the shock absorber 92 coupled between arm 26 and the chassis and shock absorber coupled between the arm 27 and the chassis. Guides such as guide 94, FIG. 2, are also provided for guiding the vertical movements of the support arms 26, 27.

Figures 5, 6, 7, 8, 9:
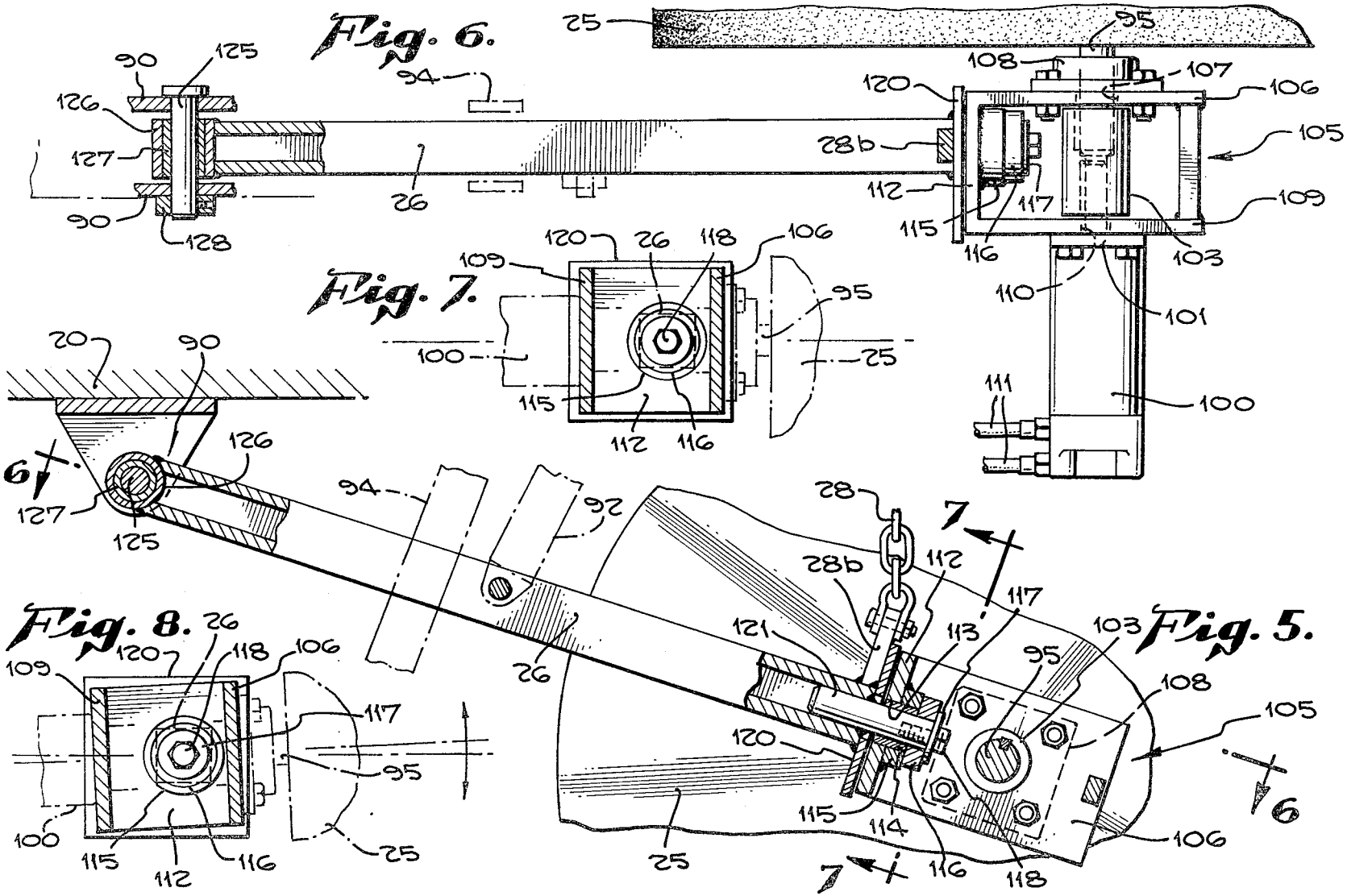
FIG. 5 is a fragmentary elevation view taken from the left-hand side of the vehicle and showing the suspension and drive mechanism for the main broom.
FIG. 6 is a top plan view taken on the line 6—6 of FIG. 5.
FIG. 7 is a cross-sectional view taken on line 7—7 of FIG. 5.
FIG. 8 is a view like FIG. 7 but showing an alternate position on the suspension mechanism corresponding to a different position of the broom.
FIG. 9 is a top plan view of the elevator drive mechanism, taken on the line 9—9 of FIG. 2 and shown partially in cross-section.

The pivotal attachment of the forward end of broom arm 26 to chassis 20 will now be briefly described. Mounting bracket 90 includes a pair of parallel vertical plates, as best seen in FIG. 6. It is also provided with a pin 125 which extends horizontally between the two plates. The forward end of arm 26 is equipped with a cylindrical sleeve 126 which extends transverse to the arm. A bushing 127 contained within the sleeve 126 is rotatably supported on the pin 125. The outer end of pin 125 is secured by a nut 128.

The main broom 25 is supported upon and rotatably driven by a shaft 95. On the right-hand side of the vehicle as shown in FIG. 1 the shaft 95 is received in a plate 96 attached to the rearward end of support arm 27 and which forms a ball joint. Thus, the position of main broom 25 is readily adjustable relative to the right-hand support arm 27.

The main broom is rotatably driven by means of a hydraulic motor 100 located on the left side of the vehicle. Hydraulic motor 100 is powered through a pair of flexible hoses 111 which extend from the main vehicle frame 21. Specific details of the suspension and drive arrangement are shown in FIGS. 5–8, inclusive. An auxiliary housing 105 having a generally hollow rectangular configuration is positioned at the rear of the broom support arm 26 and adjacent the left-hand end of the broom shaft 95. In its right-hand or inner wall 106 the auxiliary housing has an opening 107. A bearing 108 is attached to the exterior surface of wall 106 and aligned with the opening 107. The left-hand end of broom shaft 95 extends through the bearing 108 and the opening 107 and into the interior of auxiliary housing 105.

On its outer or left-hand wall 109 the auxiliary housing has an opening 110 therein. The base 101 of motor 100 is rigidly fastened to the outer wall 109 of housing 105. Motor output shaft 102 extends through the opening 110 in the auxiliary housing and is axially aligned with the broom shaft 95. A rigid coupler 103 encompasses the ends of the shafts 95, 102 and rigidly fastens them together in their axially aligned relationship.

Broom support arm 26, unlike the support arm 27, terminates at its rearward end in a transversely extending plate 120. As best seen in FIG. 5 the support arm 26 has a hollow interior, and a solid cylindrical steel shaft 121 is fitted into the interior of arm 26 and extends rearward through and beyond the plate 120. Arm 26, plate 120 and shaft 121 are firmly and rigidly secured together, as by welding. The lower end **28*b* of the restraint chain 28 is attached to arm 26 on the forward side of plate 120**.

The forward end wall 112 of auxiliary housing 105 is disposed immediately adjacent to the plate 120 and in parallel relationship thereto. Housing wall 112 also has an opening 113 which receives a bushing 114. The bushing is supported in part by a bushing collar 115 that is in turn welded to the housing wall 112. The protruding end of steel shaft 121 extends through the bushing 114 and has a washer 117 secured to its end by a bolt 118. A ring-shaped spacer 116 is positioned around the shaft between the bushing collar 115 and the washer 117.

It will therefore be seen that the auxiliary housing 105 is pivotally secured to the rearward end of the broom arm 26, and is free to rotate relative to the broom arm about the longitudinal axis of the shaft 121. At the same time the auxiliary housing 105 supports the bearing 108 in fixed position relative to the motor housing 101, and in conjunction with the coupler 103 serves to maintain the rigid alignment of the shafts 102, 95 as previously described.

As a result of this arrangement the broom 25 is enabled to pivot in a vertical plane that extends transverse to the vehicle. However, such pivoting movements do not interfere with the rotational drive of the broom, since the motor shaft 102 is directly and rigidly coupled to the broom shaft in axial alignment with it.

FIG. 7 illustrates the condition when main broom 25 is aligned parallel to the vehicle chassis 20. FIG. 8 illustrates the condition which exists when the right-hand end of the broom has been raised upward relative to its left-hand end. Here it will be seen that the auxiliary frame 105 is skewed or rotated in a counterclockwise direction relative to the plate 120.

As stated in the preceding chapter of this description, the present invention provides improvements or modifications of the MOBIL SWEEPER manufactured by Athey Products Corporation of Raleigh, N.C. In a recent improvement or modification if its machine Athey has produced a design in which a hydraulic motor is used to power the main broom. However, a chain linkage is also utilized between the hydraulic motor and the broom shaft for transmitting the power. This mechanism has not worked suitably in practice, because twisting actions of the broom relative to the vehicle main frame have also produced twisting actions in the sprocket wheels at the corresponding ends of the chain drive, resulting in malfunction of the chain drive.

In the improvements provided by the present invention, on the other hand, any twisting movements that the main broom needs to make can be freely achieved, without any interference with its rotational drive. The suspension and drive mechanism provided by the present invention is reliable in operation and substantially free of maintenance requirements.

ELEVATOR DRIVE

(FIGS. 2, 9–12)

Reference is now made to FIGS. 2 and 9–12 which illustrate the drive mechanism for the debris elevator system. As previously described, chains 37 equipped with paddles 37*a* are operated to propel the debris upward on the inclined pan 36. The upper and lower ends of the chains are mounted on upper and lower shafts 38, 39, respectively. This general arrangement is old and well-known in the art. Sprockets are carried on both shafts, such as the toothed sprockets 38*a* which support chains 37 on upper shaft 38. See FIGS. 9 and 12.

According to the invention the elevator system is driven by means of a hydraulic motor 130 which is directly coupled to the upper elevator shaft 38. Motor 130 is energized by means of a pair of flexible hoses 131 which extend from the vehicle main frame 21.

Figure 12:
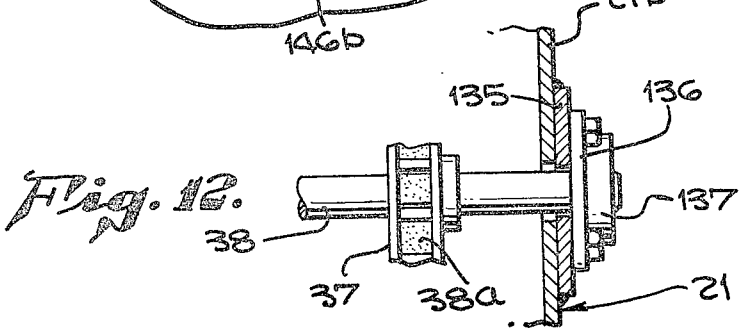
FIG. 12 is a fragmentary view taken on the right-hand side of the machine and showing the undriven end of the elevator shaft.

Reference is now made to FIG. 12 showing the suspension of upper shaft 38 on the right-hand side of the vehicle. A bearing support plate 135 is welded to the exterior surface of side wall 21*b* of the vehicle main frame 21. A bearing support bracket 136 is in turn secured to the exterior surface of plate 135. Shaft 38 extends through aligned openings in side wall 21*b*, support plate 135, and support bracket 136, and receives a bearing 137 on its outer end.

Figure 11:
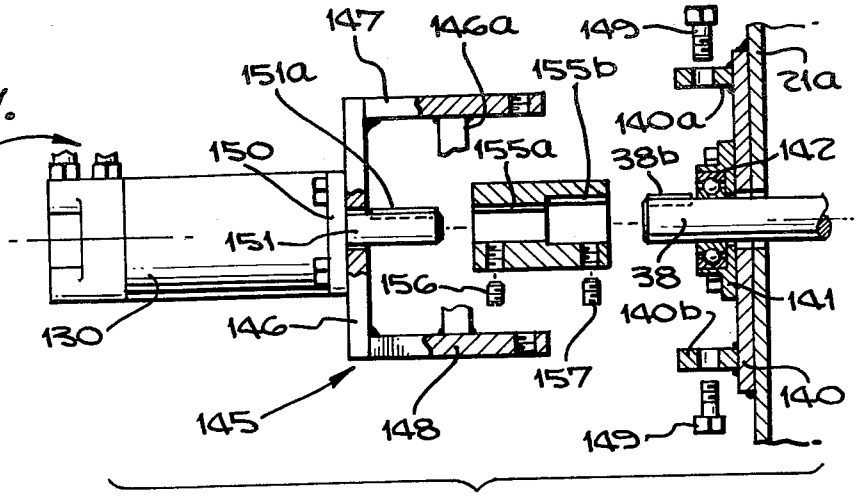
FIG. 11 is a view like FIG. 9 but showing the parts of the mechanism in an exploded relationship.
Figure 9:
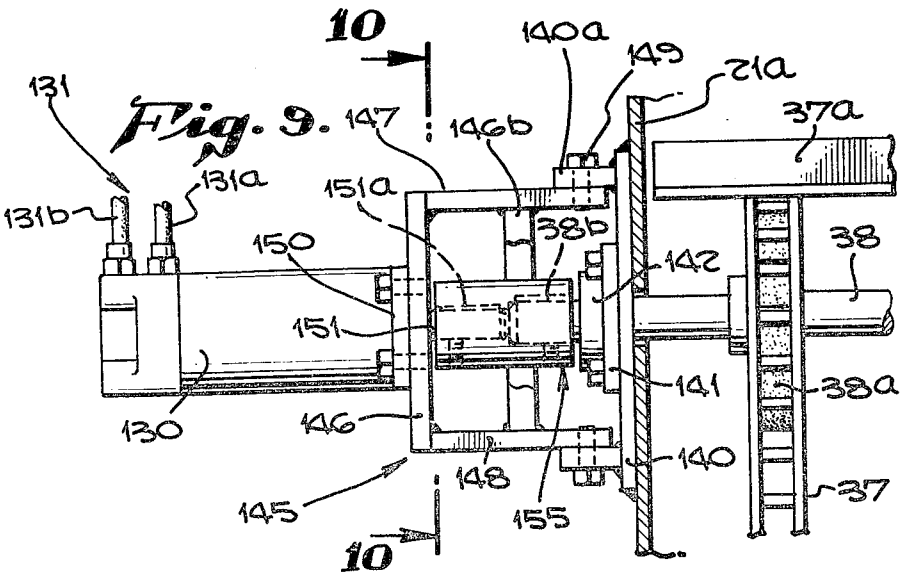
Figure 10:
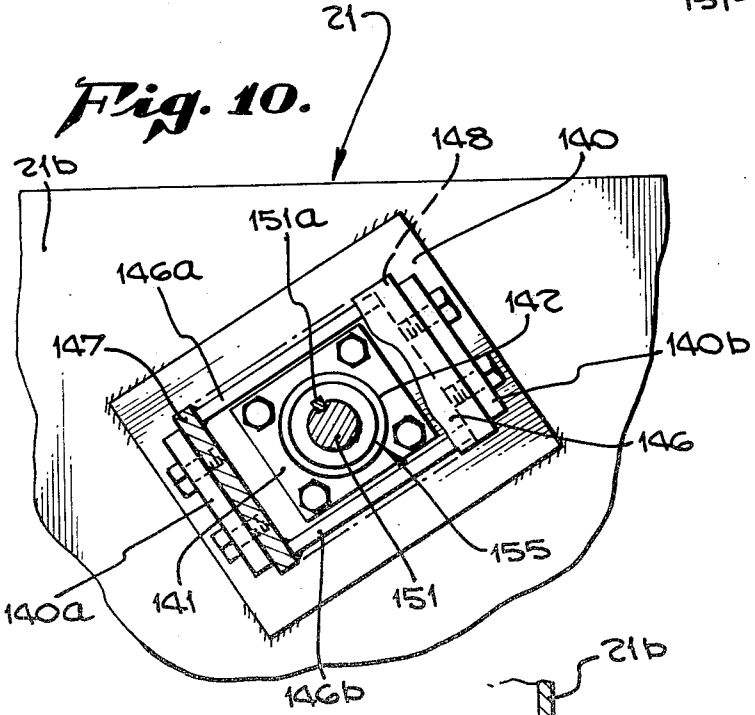
FIG. 10 is a side elevation view taken on the line 10—10 of FIG. 9, and shown partially in cross-section.

Referring to FIGS. 9–11, the similar mechanism supporting the left-hand end of upper shaft 38 will now be described. A bearing support plate 140 is welded to the exterior surface of side wall 21*a* of the vehicle frame. A bearing support bracket 141 is secured on the exterior surface of plate 140. A bearing 142 is positioned outside the bracket 141. Shaft 38 extends through aligned openings in side wall 21*a*, plate 140 and bracket 141, and receives the bearing 142. On this end, however, the shaft extends further outward, for purpose of attachment of the motor drive thereto.

Motor 130 is supported from the vehicle frame by means of a generally square, box-like auxiliary frame 145. The frame includes the mounting plate 140 previously referred to. It also includes an outer plate 146 that is parallel to the plate 140. An end plate 147 is attached to the forward end of outer plate 146 while a similar end plate 148 is attached to its rearward end. As shown in FIG. 11, the end plates 147, 148 are permanently attached to the outer plate 146. The inner ends of the end plates 147, 148 are adapted to be removably attached to the wall plate 140, as by means of bolts 149. These bolts are received by upper and lower ears 140*a*, 140*b*, respectively, of the mounting plate 140.

The hydraulic motor 130 has a base plate or housing 150 on its inner end. It also has an output shaft 151. Output shaft 151 extends through a suitable opening in the outer plate 146 of the auxiliary frame 145, and is axially aligned with the upper elevator shaft 38. See FIG. 9. The two shafts are then rigidly secured together by means of a removable coupler 155. As shown in FIG. 11 the coupler 155 is secured to corresponding shafts by means of removable set screws 156, 157, respectively. The coupler 155 has keyways 155*a*, 155*b* which receive keys 151*a*, 38*b* which are rigidly secured to the corresponding shafts. Auxiliary frame 145 also includes support struts, 146*a*, 146*b* which extend parallel to outer plate 146, and are secured to the end plates 147, 148.

In the prior art machines the upper shaft 38 has carried a sprocket on its protruding end which sprocket is then rotatably driven by means of a chain drive from a remotely located power source. That prior art drive mechanism has imposed a constant bending load on the shaft, resulting in maintenance problems. These problems have been particularly troublesome because of the relative inaccessibility of the elevator mechanism. According to the present invention the bearings 137, 142 are located external to the vehicle main frame on their corresponding bearing support brackets 136, 141. The bearing support brackets are removable, which makes necessary maintenance procedures for the bearings much easier to accomplish.

According to the invention the rigid coupler 155 may be disconnected from the shafts, and auxiliary housing 145 may be detached from the vehicle. This procedure provides easily accessibility to the bearing 142 and also permits convenient inspection and repair or replacement of the motor 130 if that should be necessary.

Another advantage of the direct drive arrangement provided in accordance with the present invention is that the play or tolerance that existed in the previously used chain drive mechanisms has been eliminated from the system. The direct driving action achieved by the hydraulic motor 130, with its output shaft axially aligned with the upper elevator shaft 38, reduces the wear on the chains 37 of the elevator system.

Perhaps even a more important advantage of the direct elevator drive of the present invention is that it is amenable for use in conjunction with the novel elevator control system that is described in the next chapter of this description.

CONTROL SYSTEM FOR ELEVATOR DRIVE

Figure 13:
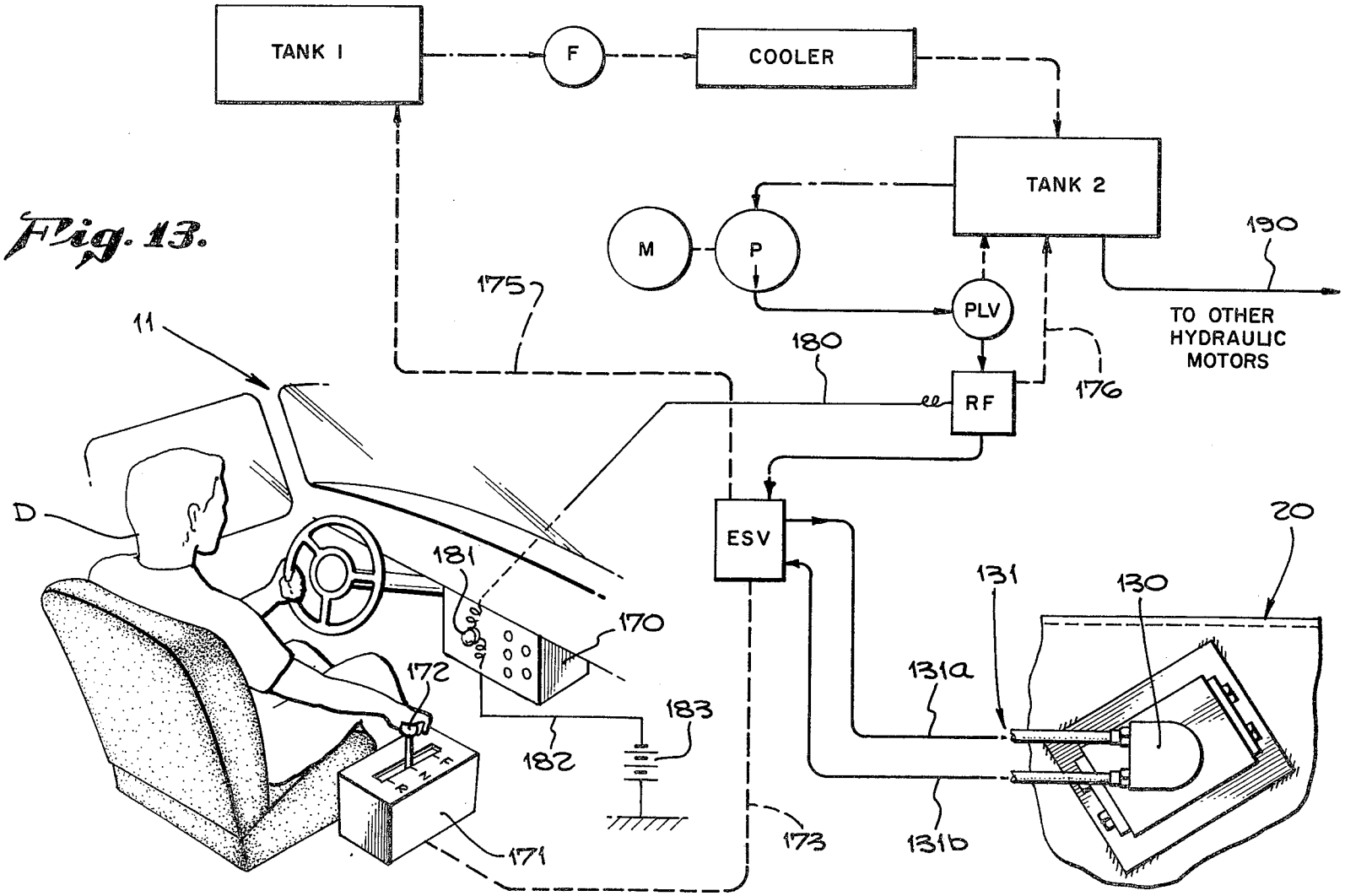
FIG. 13 is a schematic view shown partially in perspective, showing the control system for the elevator.

(FIGS. 2 and 13)

As is apparent from FIGS. 1 and 2 and the foregoing description of the debris elevator system, both the elevator system and the dirt bin are contained within the main vehicle housing 21 and hence cannot be observed by the operator while he is driving the vehicle. In the past serious problems have been experienced when the debris elevator has become jammed due to an intake of excessive debris, or large boulders or the like which the mechanism is not designed to accept. Such jamming actions have usually been detected only rather belatedly by the driver, either because he could observe through a rear view mirror that the vehicle was no longer picking up debris, or else because an auxiliary engine used to power the elevator would stall due to an excessive overload. In many instances, in the operation of the prior art machines, jamming of the elevator could result in serious damage to parts of the mechanism, requiring that the vehicle be taken out of service and major repairs be made.

According to the present invention a hydraulic control system utilized in conjunction with the elevator drive motor 130 is so arranged as to instantly detect any overload on the elevator, and to then shut off the elevator power in response to the overload. At the same time an indicator light in the driver's cab is energized so that the driver will know that the debris elevator has stopped working.

Referring now to FIG. 2, in the street sweeping vehicle of the present invention the driver's cab 11 is equipped with an instrument panel 170. It also contains an elevator control console 171 equipped with an elevator control lever 172. As shown in FIG. 13, the control console is located conveniently beside the driver D.

The complete hydraulic system as illustrated schematically in FIG. 13 includes a reservoir, Tank 2, from which hydraulic fluid is continuously drawn by a pump P. Pump P is driven by a motor M. Hydraulic fluid delivered from pump P flows to a pressure limiting valve PLV where if the pressure is excessive, a portion of the flow is then diverted back to Tank 2. The main output of the limiting valve PLV is delivered to a relief valve RF. The function of the relief or safety valve is described in a later paragraph.

The output of relief valve RF then flows to an elevator selector valve ESV. From valve ESV the hydraulic fluid is supplied through an input line 131*a* to the elevator drive motor 130, while the return flow is carried through a return line 131*b* back to the valve ESV. From valve ESV the spent fluid is then returned through a return line 175 to a return tank designated as Tank 1. From Tank 1 the fluid then circulates through a filter F and a COOLER to the Tank 2.

Elevator selector valve ESV is of conventional construction and is adapted to provide either forward, reverse, or neutral drive to the motor 130. A mechanical linkage between control console 171 and the valve ESV is indicated by dotted line 173. Thus the driver by changing the position of lever 172 may either drive the debris elevator system in the forward direction, drive it in the reverse direction, or stop its operation altogether. The direction of fluid flow in lines 131*a*, 131*b* is reversed when the drive is reversed.

The safety function which the control system provides for the elevator drive will now be described. Relief valve RF is of a well-known type which performs two separate functions when subjected to excessive pressure. First, it returns fluid through a relief line 176 to Tank 2. And second, through the movement of a movable plate, not specifically shown, it completes a ground connection for an electrical conductor 180. Conductor 180 extends to an indicator light 181 that is located on the instrument panel 170 of the vehicle. A conductor 182 extending from the other terminal of the indicator light is connected to a battery 183.

Therefore, when the elevator system jams, the driving pressure applied to motor 130 rises until a predetermined level is reached, at which point the relief valve RF comes into operation. The hydraulic pressure will not rise further because the excess is relieved through exhaust line 176. At the same time the completion of the electrical circuit causes the indicator light 181 to be energized. The driver then knows that the elevator system is in trouble, and he is therefore able to take appropriate action. For example, he may immediately shift the elevator drive from forward to neutral, stop the forward travel of his vehicle, and then shift the elevator drive to reverse. Other appropriate maneuvers can be made as indicated by the experience and skill of the operator. When the overload on motor 130 is effectively relieved there will no longer be a flow of fluid through exhaust line 76 to Tank 2, and the electrical circuit will then be interrupted so that indicator light 180 goes off. The driver then knows that the excessive load problem has been overcome.

Also included in the hydraulic supply and control system is an output line 190 leading from Tank 2 which supplies energy to other hydraulic motors. The main broom motor or the gutter broom motors may be driven from this same system if so desired.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. In a street sweeping vehicle having a driver's cab, a debris elevating system driven by a hydraulic motor, and brush means for feeding debris to the elevator system, apparatus for energizing the motor and controlling its operation, comprising:

a source of fluid pressure;

selector valve means coupled between said source and the hydraulic motor and selectively operable in one of three modes either for shutting off the flow of energy to the motor, for energizing the motor in a forward direction, or for energizing the motor in a reverse direction;

handle-actuated means located in the driver's cab for switching said selector valve means to a selected one of its three operating modes;

relief valve means associated with said source and responsive, whenever said elevating system becomes jammed, to relieve the pressure developed from said source when the same reaches a maximum safe level; and visual indicator means visible from the driver's cab and coupled to said relief valve means and responsive to said maximum safe pressure level for indicating that the elevating system is jammed.

2. A street sweeping machine comprising, in combination:

a vehicle having front and rear wheels, a driver's cab, and a main frame;

a debris elevating system disposed within said vehicle main frame, including an inclined pan, upper and lower elevator shafts extending transversely across the upper and lower ends of said pan, respectively, a pair of sprockets on each of said shafts, at least two circular chains carried by said sprockets, and transversely extending paddles carried by said chains for sweeping debris from a roadway surface upward along said pan;

a main broom carried beneath the vehicle and disposed rearwardly of the lower end of said inclined pan;

said vehicle main frame having generally vertical side walls, openings through said side walls through which corresponding ends of said upper elevator shaft extend, and corresponding bearings supported by said side walls for receiving and rotatingly supporting the corresponding ends of said elevator upper shaft;

one end of said elevator upper shaft protruding laterally beyond the corresponding side wall of said main frame for purpose of being rotatably driven;

an auxiliary housing removably attached to the exterior surface of the side wall associated with said protruding shaft end;

a hydraulic motor having a motor housing and an output shaft, said output shaft being axially aligned with said protruding end of said upper elevator shaft;

means rigidly coupling said motor shaft to said upper elevator shaft;

means rigidly securing said motor housing to said auxiliary housing;

a pair of flexible hoses extending from said vehicle main frame to said motor housing for energizing said motor, whereby the driven rotation of said elevator upper shaft may be accomplished without imposing any bending stress thereon;

a source of fluid pressure associated with said vehicle main frame for supplying hydraulic fluid to said flexible hoses;

handle actuated means located in the driver's cab of the vehicle and selectively operated for either coupling said source of fluid pressure to said hoses, or reversing same, or interrupting same;

relief valve means associated with said source of fluid pressure and responsive whenever said debris elevating system becomes jammed to limit the pressure developed from source to a maximum safe level; and visual indicator means visible from the driver's cab and coupled to said relief valve means and responsive to said maximum safe pressure level for indicating that the elevating system is jammed.

* * * * *